US006624733B1

(12) United States Patent
Swenson, Jr.

(10) Patent No.: US 6,624,733 B1
(45) Date of Patent: Sep. 23, 2003

(54) ADAPTABLE SOLENOID WITH BREAK-OFF TABS

(75) Inventor: Roger M. Swenson, Jr., Williamsville, MO (US)

(73) Assignee: Trans-A-Matic, Poplar Bluff, MO (US)

( * ) Notice: Subject to any disclaimer, the term of this patent is extended or adjusted under 35 U.S.C. 154(b) by 0 days.

(21) Appl. No.: 09/896,126

(22) Filed: Jul. 2, 2001

(51) Int. Cl.[7] ..... H01F 27/06

(52) U.S. Cl. ..... 336/65; 336/192; 336/67; 336/229

(58) Field of Search ..... 336/229, 67, 65, 336/192; 192/110 R, 111 R, 70.25; 74/606 R

(56) References Cited

U.S. PATENT DOCUMENTS 5,009,250 A * 4/1991 Kline et al. ..... 137/596.17
5,127,434 A * 7/1992 Kline et al. ..... 137/596.17
5,699,890 A 12/1997 Swenson, Sr. ..... 192/110 R
6,085,615 A 7/2000 Kirkendall ..... 74/606 R

* cited by examiner

*Primary Examiner*—Anh Mai
(74) *Attorney, Agent, or Firm*—Jim Zegeer

(57) ABSTRACT

A solenoid assembly has a U-shaped bracket with outwardly extending mounting appendages. A solenoid coil has one end supported by the U-shaped bracket, a centerplate for centering and supporting the opposite end of the solenoid coil and a trapping plate for trapping the centerplate and solenoid coil in the U-shaped bracket. The U-shaped bracket has at least one tear-off tab attachment appendage and a break-off necked-down portion connecting the at least one attachment appendage to the U-shaped bracket whereby the tear-off tab can be torn off by twisting either up or down, side to side, or by rotating the tab around the neck axis.

4 Claims, 3 Drawing Sheets

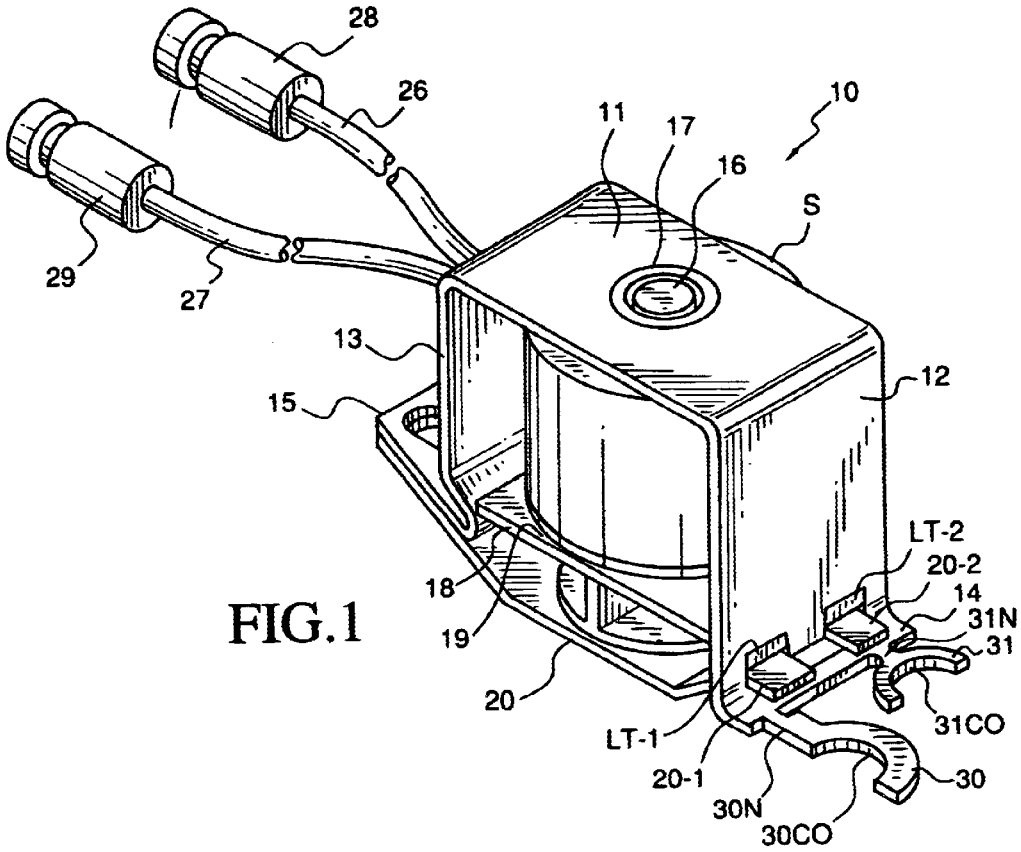
FIG.1
FIG.2
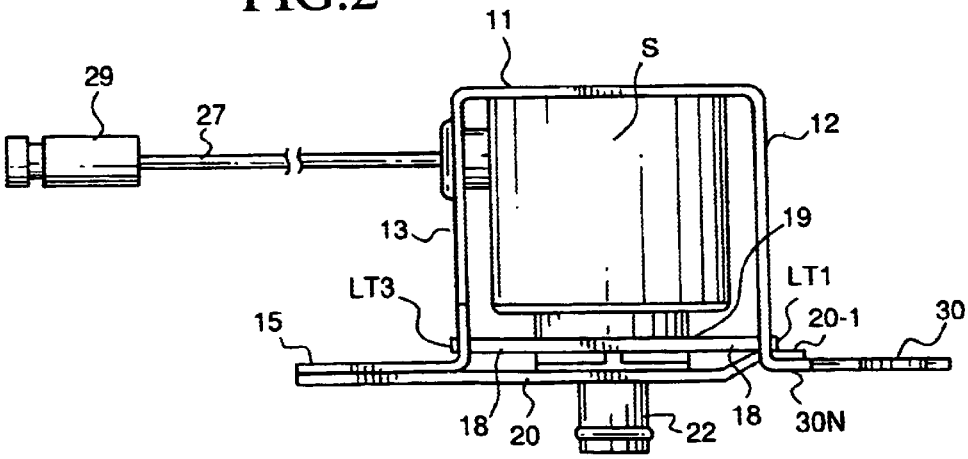

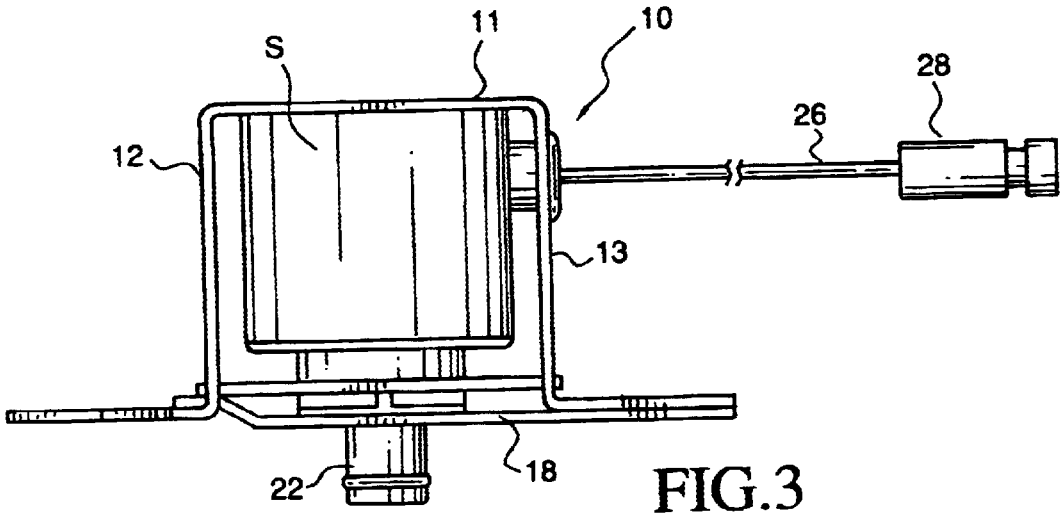
FIG.3
FIG.4
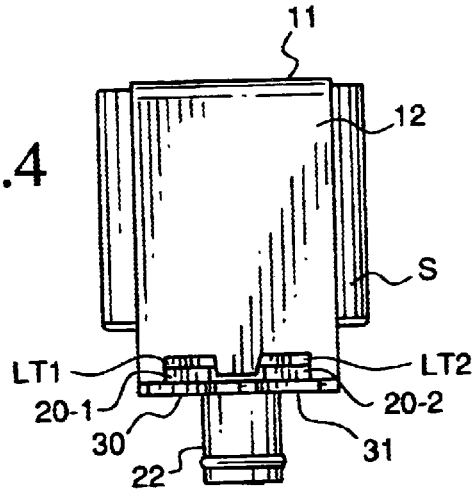
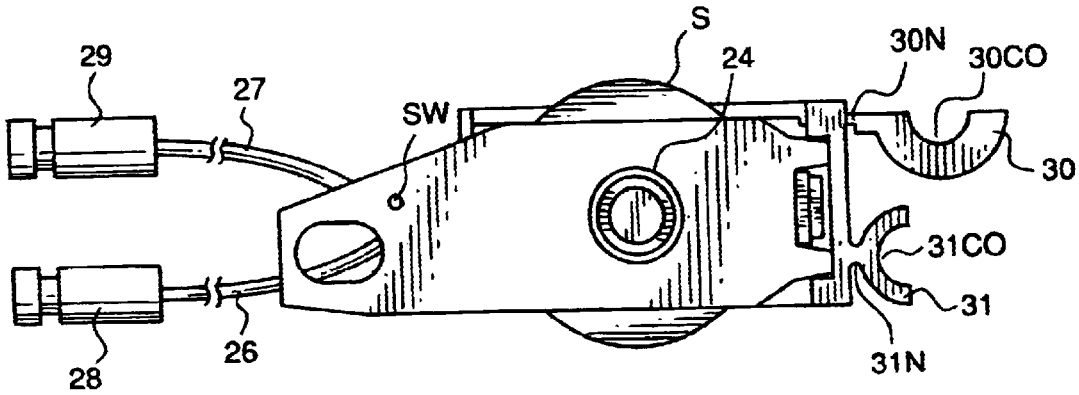
FIG.5

ADAPTABLE SOLENOID WITH BREAK-OFF TABS

REFERENCE TO RELATED APPLICATION

This application is related to Design Application Serial No. 29/143,788, filed Jun. 21, 2001 entitled BREAK-AWAY APPENDAGES FOR MOUNTING BRACKET.

FIELD OF THE INVENTION

This invention relates to solenoid brackets, more particularly, the invention relates to mounting brackets which have one or more break-off tabs to enable the solenoid to be fitted a number of different uses.

BACKGROUND OF THE INVENTION

Kirkendall U.S. Pat. No. 6,085,615 discloses a mounting bracket for solenoids on vehicle transmissions in which a centerplate which has attachment appendages detachably secured to the centerplate and which can be removed from the centerplate to allow the bracket to fit a number of vehicle transmissions. Kirkendall's preferred method of detachably securing the attachment appendages is to provide a thinner area or score line where the attachment appendages are secured to the bracket. Attachment appendages can also be cemented to the bracket as long as the bond can be readily broken. Swenson, Sr. U.S. Pat. No. 5,699,890 discloses a system for maintaining clutch pedal height after clutch resurfacing in which a shim or annular plate has an inner aperture and a plurality of break-away tabs on the inner aperture which are adapted to be broken away to accommodate larger diameter crank shaft hubs.

SUMMARY OF THE INVENTION

The primary object of the present invention is to provide necked tear-off tabs for solenoids to fit multiple applications. One objective of the present invention is to provide a mounting bracket having a tear-off tab which is easier to break off than the prior art and uses less material.

A further object of the invention is to provide a tear-off tab which can be removed without tools.

Another object of the invention is to provide a tear-off tab which can be placed closer together without having to put a break-off tab on a break-off tab.

Another object of the invention is to provide a necked tear-off tab which is clear of any obstructions or other bolts without their removal and replacement.

Still another object of the invention is to provide a tear-off tab which can be removed either with or without the other being removed.

Still another object of the invention is to provide a tear-off tab which can be torn off by one twisting, either up or down and side to side or by rotating a tab about the neck axis.

Another object of the invention is to provide a tear-off tab which is formed integrally with the U-shaped frame of the solenoid bracket and is independent of the centerplate thereof.

DESCRIPTION OF THE DRAWINGS

The above and other objects, advantages and features of the invention will become more apparent when considered with the following specification in conjunction with the accompanying drawings wherein:

FIG. 1 is an isometric perspective view of a transmission lock-up solenoid incorporating the break-off tabs of this invention, FIG. 2 is a side elevational view thereof, FIG. 3 is a reverse view from FIG. 2, FIG. 4 is an end view thereof, FIG. 5 is a bottom plan view.

DETAILED DESCRIPTION OF THE INVENTION

Figure 6A:
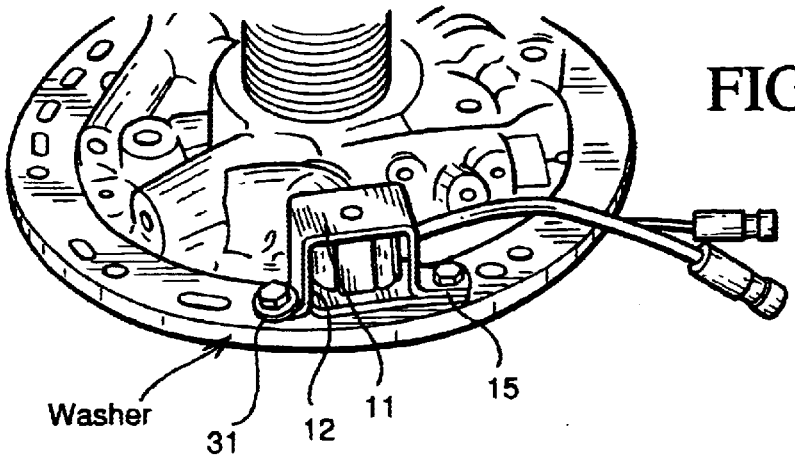
FIGS. 6A, 6B and 6C are diagrammatic illustrations of different transmissions on which lock-up solenoids can be used.

Referring now to FIGS. 1 and 2, the multiple application lock-up solenoid of the present invention includes a U-shaped frame 10 having base member 11, side members 12 and 13, and outwardly extending arms 14 and 15, respectively. Solenoid coil S has a core member 16 which fits in annular aperture 17 in base member 11. A centerplate 18 has an aperture 19 which receives and, in conjunction with bottom plate 20, supports the opposite end of the solenoid coil and core structure. The lateral ends of the centerplate 18 are provided with locking tabs LT1, LT2, LT3 which project through slots S1, S2, S3 in legs 12 and 13 of the U-shaped bracket frame 10. Trapping plate 20 has outwardly projecting tabs 20-1 and 20-2 which project through slots S1, S2 beneath locking tabs LT1 and LT2 so that centerplate 18 is trapped when the bottom plate 20 is spot-welded to lateral tab 15 on U-shaped bracket member 10. A neck with a tip 22 of the solenoid mechanism S projects through aperture 24 in trapping plate 20. Trapping plate 20 is spot-welded to mounting tab 15 and has an aperture which aligns with an aperture in the mounting tab 15 which receives a transmission mounting bolt (not shown).

A pair of solenoid wires 26, 27 having connectors 28, 29 are connected to solenoid coil S.

THE PRESENT INVENTION

The present invention is concerned with break-off mounting tabs 30, 31 which are integrally formed with the U-shaped mounting bracket 10. These two break-off tabs are unique in that neck portions 30N and 31N have cross-sectional areas across their necks 30N and 31N which make it easier to break off. In a preferred embodiment, the cross-sectional area is a square or approximately a square which enables the break-off tabs to be torn off by twisting either (1) up or down, (2) side-to-side, or (3) rotating the tab around the neck axis. Each tab has an arcuate member 30CO, 31CO to receive bolts on the transmission. Note that each tear-off tab can be placed closer together without having a break-off tab on a break-off tab. Moreover, it is easier for the next tab to clear any obstructions or other bolts without the removal and replacement because there is less metal involved. Moreover, although the tabs can be broken off using a pair of pliers, they can also be broken off without using any tools at all.

By necking down the tear-off tabs instead of using a thinner area or score lines, a thinning or scoring operation is eliminated.

Figure 6B:
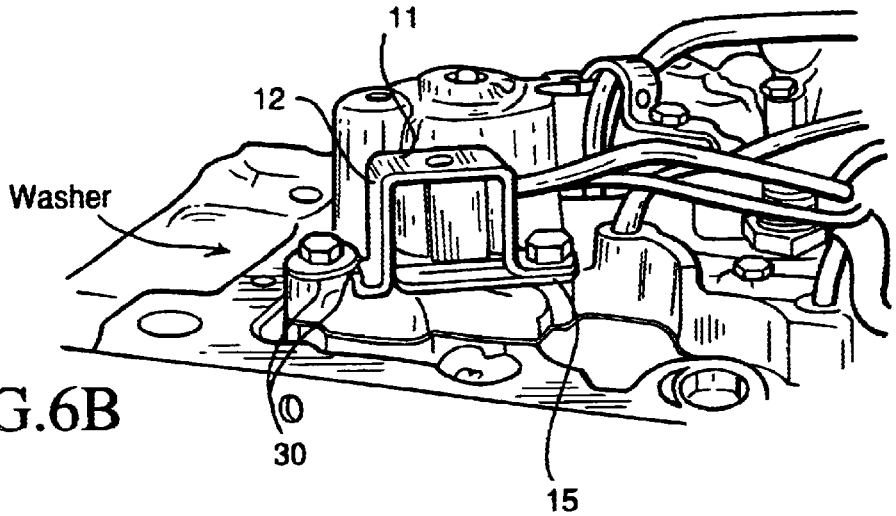
Figure 6C:
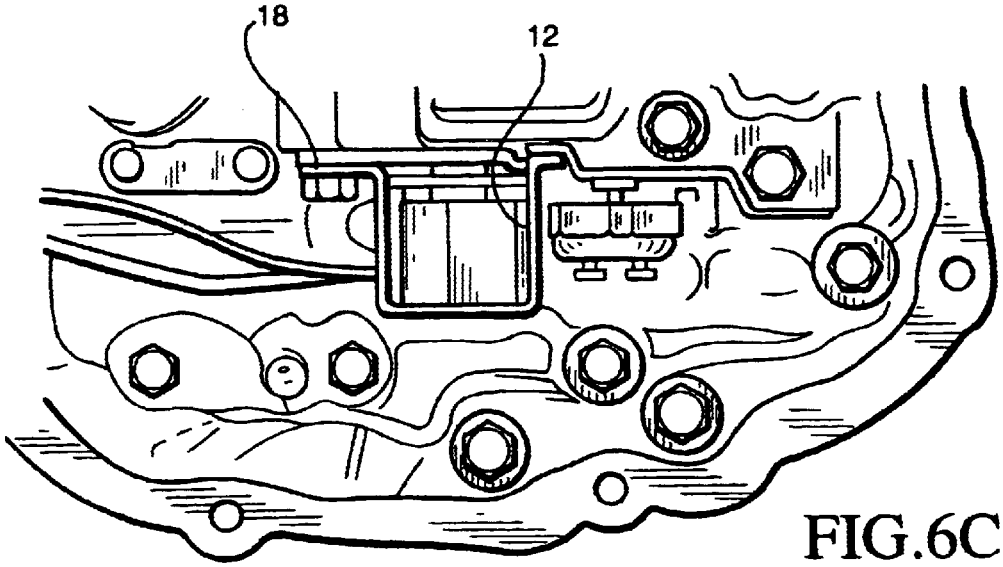

The solenoid has two break-off tabs 30, 31. To install in one type of transmission, one tab may be broken off, say the long tab 30, and then installed with bolts using the shorter tab 31 and the main mounting extensions 15 and the trapping plate extension 20 as illustrated in FIG. 6A. To install the solenoid on a further type of transmission, the short tab 31 is broken off and the solenoid mounted as diagrammatically illustrated in FIG. 6B. Still a third manner of utilizing the break-off tabs of the present invention, both break-off 30 and 31 tabs are broken off and bolted onto the transmission as diagrammatically illustrated in FIG. 6C.

While the invention has been described and illustrated in respect to its preferred embodiments, it will be appreciated that other embodiments and adaptations of the invention will readily occur to those skilled in the art.

What is claimed is:

1. In a solenoid assembly having a U-shaped bracket with outwardly extending mounting appendages, a solenoid coil having one end supported by said U-shaped bracket, a centerplate for centering and supporting the opposite end of said solenoid and a trapping plate for trapping said centerplate and solenoid in said U-shaped bracket and secured to said U-shaped bracket, the improvement comprising at least one tear-off tab attachment appendage having a break-off necked-down portion connecting said at least one attachment appendage to said U-shaped bracket, said necked-down portion having a neck axis, whereby said tear-off tab can be torn off by twisting either up or down, side to side, or by rotating the tab around the neck axis.

2. The invention defined in claim 1 wherein said necked-down portion is approximately a square in cross-section.

3. The invention defined in claim 1 wherein there are a plurality of independent tear-off tab attachment appendages and corresponding break-off necked-down portions.

4. The invention defined in claim 1 wherein said tear-off tab is adapted to clear obstructions or other bolts without the removal.

* * * * *